United States Patent [19]

Leonardo

[11] Patent Number: 4,895,525

[45] Date of Patent: Jan. 23, 1990

[54] CABLE SHIELD GROUNDING CLAMP CONNECTOR

[75] Inventor: Ignazio E. Leonardo, Union, N.J.

[73] Assignee: A K Stamping Co. Inc., Mountainside, N.J.

[21] Appl. No.: 304,753

[22] Filed: Jan. 31, 1989

[51] Int. Cl.[4] ..... H01R 4/66

[52] U.S. Cl. ..... 439/99

[58] Field of Search ..... 439/98, 99, 411, 412; 174/78, 88 R, 88 C

[56] References Cited

U.S. PATENT DOCUMENTS

| | | | |
|---|---|---|---|
| Re. 28,468 | 7/1975 | Baumgartner et al. | 439/99 |
| 3,253,247 | 5/1966 | Vos | 174/78 |
| 3,778,749 | 12/1973 | Kapell | 439/411 |
| 4,176,893 | 12/1979 | Olszewski et al. | 439/99 |
| 4,353,612 | 10/1982 | Meyers | 439/411 |
| 4,449,768 | 5/1984 | Koncelik et al. | 439/98 |
| 4,561,708 | 12/1985 | Sorlien et al. | 439/99 |

FOREIGN PATENT DOCUMENTS

| | | | |
|---|---|---|---|
| 3209338 | 9/1983 | Fed. Rep. of Germany | 439/99 |

*Primary Examiner*—Gary F. Paumen

*Attorney, Agent, or Firm*—Samuelson & Jacob

[57] ABSTRACT

A cable shield grounding clamp connector includes an outer plate for seating upon the insulating jacket of a shielded electrical cable and an inner plate for interposition between the inner core of insulated conductors of the cable and the shield of the cable, the outer plate being curved to conform to the outer diameter of the cable and the inner plate being resiliently deflectable relative to the outer plate so as to be urged toward conformance with the curvature of the outer plate upon clamping of the jacket and the shield between the outer plate and the inner plate, the inner plate having sharp-edged teeth arranged in longitudinal rows along laterally opposite edges of the inner plate for scraping away a corrosion-inhibiting coating on the shield in response to deflection of the inner plate to expose the shield for direct electrical contact between the inner plate and the shield.

9 Claims, 1 Drawing Sheet

CABLE SHIELD GROUNDING CLAMP CONNECTOR

The present invention relates generally to electrical connectors and pertains, more specifically, to a grounding clamp connector for an electrical cable shield, and still more particularly, to a grounding clamp connector for making a ground connection in a telephone cable, either above or below ground.

A wide variety of cable shield connectors is available for terminating the shield of an electrical cable so as to provide a reliable ground connection to the shield. In telephone cables now in use, the shield of the cable generally is constructed in the form of a metallic sheath, usually of aluminum, and is provided with a corrosion-inhibiting coating, usually in the form of a polymer coating. Since the polymer coating is dielectric, it becomes necessary to penetrate the coating in order to establish good electrical contact with the shield.

The present invention is directed to a grounding clamp connector constructed especially for use in connection with telephone cable of the type described above, and provides several objects and advantages, some of which may be summarized as follows: Establishes a good electrical connection with the shield of the electrical cable by scraping away portions of the coating on the shield to expose corresponding portions of the metallic sheath of the shield for direct electrical contact between the grounding clamp and the shield; accomplishes the desired electrical contact automatically, in response to a simple installation procedure, without a significant departure from current conventional installation procedures; facilitates installation in the field; compensates for displacement of the materials of the cable resulting from deformation and from temperature differences so as to maintain an effective ground connection during service; enables economy through simplicity of construction and ease of use; employs a minimal number of component parts of reduced complexity; and provides exceptional reliability over an extended service life.

The above objects and advantages, as well as further objects and advantages, are attained by the present invention which may be described briefly as an improvement in a cable shield grounding clamp connector for establishing an electrical connection with the shield of an electrical cable having an inner core of insulated conductors, an outer insulating jacket with an outer diameter, and a shield between the inner core and the outer jacket, the shield having an inner surface and including a metallic sheath and a corrosion-inhibiting coating on the metallic sheath at least along the inner surface of the shield, the improvement effecting the electrical connection and maintaining the electrical connection continuously during service in the field, the improvement comprising: an outer plate extending longitudinally between opposite ends and having a transverse cross-sectional configuration curved circumferentially along an arc of a first radius to conform essentially to the outer diameter of the jacket; an inner plate extending longitudinally between opposite ends and laterally between opposite edges, the inner plate including a web portion curved circumferentially between the laterally opposite edges along an arc of a second radius; clamping means for urging the outer plate and the inner plate toward one another; and scraping means located along the laterally opposite edges of the inner plate for projecting toward the outer plate when the inner plate and the outer plate are juxtaposed with one another, with the jacket and the shield interposed between the juxtaposed outer plate and inner plate; the second radius being related to the first radius such that upon urging the outer plate and the inner plate toward one another, the inner plate will be resiliently deflected toward conformance with the curved configuration of the outer plate and the scraping means will be displaced concomitantly circumferentially along the shield to scrape away portions of the coating and make electrical contact with corresponding portions of the metallic sheath, and will be biased continuously toward the metallic sheath to maintain the electrical contact continuously during service in the field.

The invention will be understood more fully, while still further objects and advantages will become apparent, in the following detailed description of a preferred embodiment of the invention illustrated in the accompanying drawing, in which.

Figure 1:
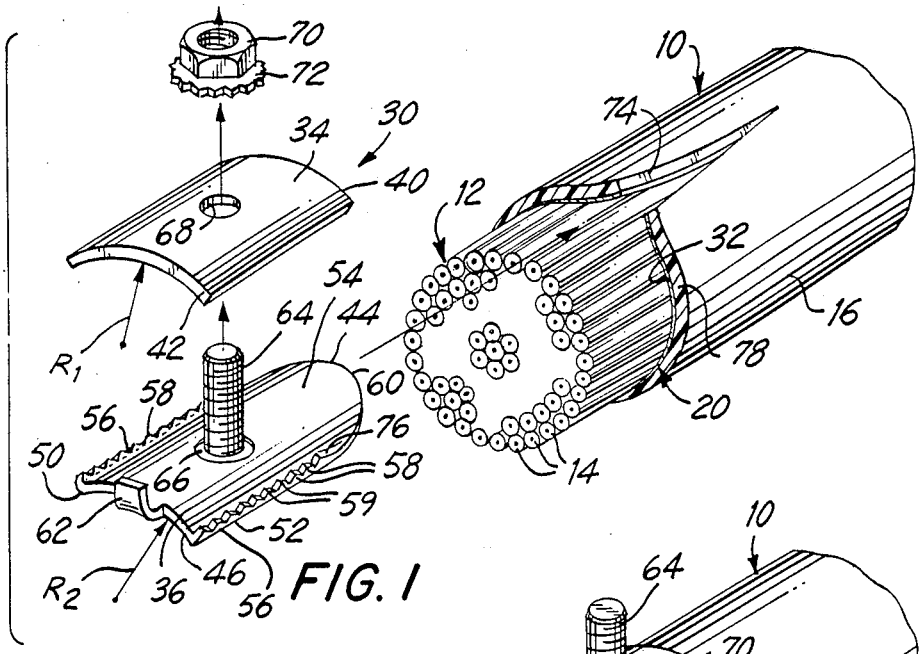
FIG. 1 is an exploded perspective view of a grounding clamp connector constructed in accordance with the invention, about to be installed in a shielded electrical cable, at the terminal end of the shield thereof.

Referring now to the drawing, and especially to FIG. 1 thereof, a shielded electrical cable is shown in the form of telephone cable 10 and is seen to have a conductive core 12 made up of a plurality of individually insulated conductors 14, and a jacket 16 of electrical insulation surrounding the core 12. A shield 20 is interposed between the core 12 and the jacket 16 and includes a metallic sheath 22 (see FIG. 3), in the form of an aluminum tape. In order to inhibit corrosion of the metallic sheath 22, the sheath 22 is coated with a corrosion-inhibiting material, as illustrated by a coating 24 of a suitable polymer, such as polyethylene.

A grounding clamp connector 30, constructed in accordance with the invention, is about to be installed adjacent the terminal end 32 of the shield 20, and is seen to include an outer plate 34 and an inner plate 36. Outer plate 34 extends longitudinally between opposite ends 40 and 42 and has an arcuate transverse cross-sectional configuration curved circumferentially along an arc of a first radius $R_1$ to conform essentially to the outer diameter of the jacket 16. Inner plate 36 extends longitudinally between opposite ends 44 and 46 and laterally between opposite longitudinal edges 50 and 52, and includes a web portion 54 having an arcuate transverse cross-sectional configuration curved circumferentially along an arc of a second radius $R_2$. A longitudinal rib 56 is unitary with each edge 50 and 52 and projects radially outwardly from the web portion 54 of the inner plate 36, each longitudinal rib 56 carrying scraping means in the form of a plurality of teeth 58 unitary with the corresponding rib 56 and projecting generally radially outwardly with respect to the web portion 54, teeth 58 having sharp edges 59 and being spaced along the length of the rib 56 in a longitudinal row.

Inner plate 36 includes a rounded leading edge 60 along the end 44 thereof and a tang 62 projecting outwardly from the trailing end 46. A threaded post 64 is affixed to the web portion 54 of the inner plate 36, as by staking or welding at 66, and projects outwardly to pass through a corresponding aperture 68 in the outer plate 34 for engagement with a threaded fastener in the form of a nut 70 carrying an integral toothed lock washer 72, the post 64 and nut 70 providing clamping means for clamping together the outer plate 34 and the inner plate 36 upon installation of the grounding clamp connector 30, as will be described in detail below.

Figure 2:
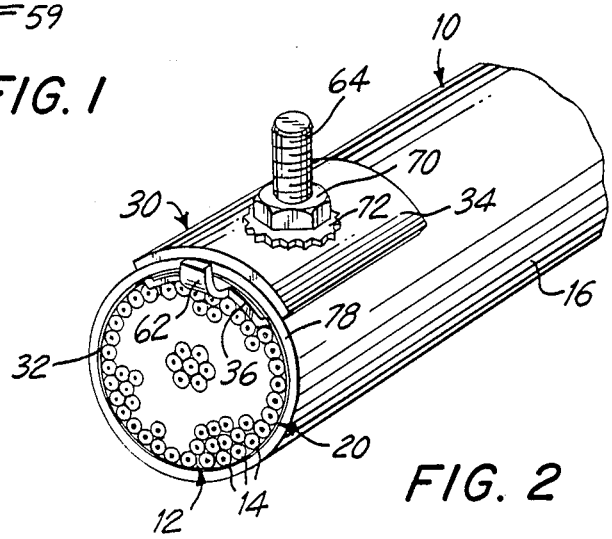
FIG. 2 is a perspective view similar to FIG. 1, with the grounding clamp connector installed.

Installation of the grounding clamp connector 30 is accomplished by first slitting the jacket 16 and the shield 20 to establish a longitudinal slit 74 passing through the jacket 16 and the shield 20. Then, the inner plate 36 is slipped between the shield 20 and the core 12 of the cable 10, with the post 64 entering the slit 74. Insertion of the inner plate 36 between the shield 20 and the core 12 and longitudinal advancement of the inner plate 36 along the cable 10 are facilitated by the rounded configuration of leading edge 60 and by outwardly sloping ramps 76 at the leading ends of the ribs 56 which encourage the shield 20 to ride over the ribs 56, and the teeth 58, until the tang 62 arrives at the terminal end 78 of the jacket 16, as illustrated in FIG. 2, and the inner plate 36 is fully embedded beneath the jacket 16 and the shield 20. The channel-like lateral cross-sectional configuration of the inner plate 36, provided by the curved web portion 54 and the radially-outwardly projecting ribs 56, creates a degree of longitudinal rigidity which permits such insertion of the inner plate 36 without buckling. In addition, tang 62 provides a purchase for an operator to urge the inner plate 36 longitudinally forward during insertion. Once the inner plate 36 is fully embedded, as described above, outer plate 34 is juxtaposed with the inner plate 36, with the post 64 passing through the aperture 68, and the nut 78 is threaded onto the post 64 and advanced against the outer plate 34, as seen in FIG. 3.

Figure 3:
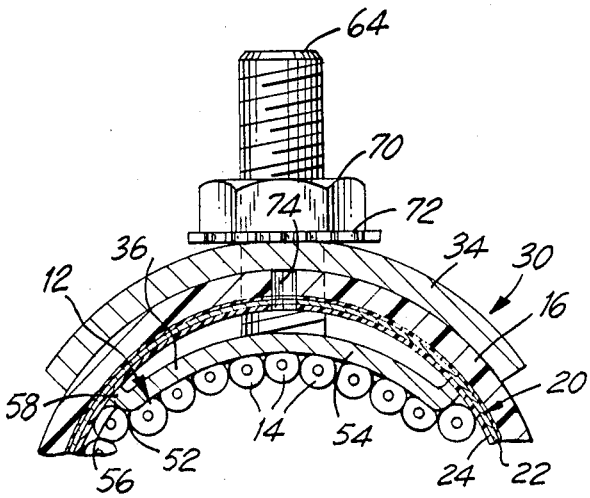
FIG. 3 is an enlarged transverse cross-sectional view taken along line 3—3 of FIG. 2, as the grounding clamp connector is being installed.
Figure 4:
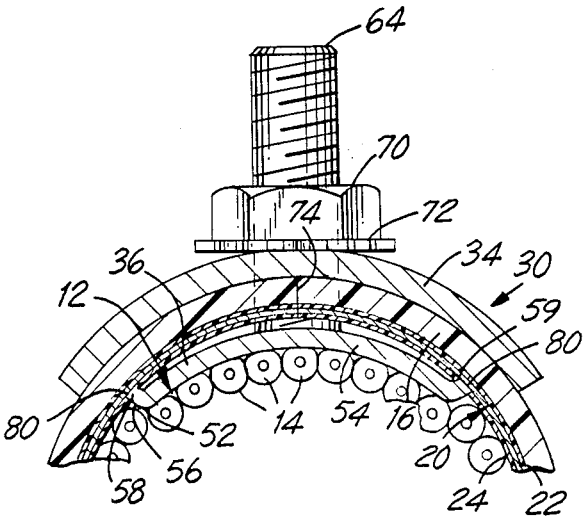
FIG. 4 is transverse cross-sectional view similar to FIG. 3, with the grounding clamp connector fully installed.

Turning now to FIGS. 3 and 4, radius $R_2$ is somewhat greater than radius $R_1$, and the inner plate 36 is resiliently deflectable in radial directions, as compared to the stiffer outer plate 34. Thus, outer plate 34 is constructed with a greater cross-sectional thickness in the radial direction than is web portion 54 of inner plate 36 so that outer plate 34 resists radial deflection, while inner plate 36 is resiliently deflectable in radial directions. Upon advancement of the nut 78 along the post 64, toward the outer and inner plates 34 and 36, the outer plate 34 is seated firmly upon the jacket 16 and the inner plate 36 is drawn radially toward the outer plate 34. Since the inner plate 36 is resiliently deflectable, the inner plate 36 will be deflected toward conformance with the curvature of the outer plate 34, and the ribs 56 will be rocked laterally as the web portion 54 of the inner plate 36 flexes toward conformity with the curvature of the outer plate 34. The ribs 56 are relatively short in the radial direction, and therefore are quite stiff, so that the rocking of the ribs 56 causes concomitant rocking of the teeth 58, the sharp edges 59 of which teeth 58 are engaged with the coating 24 on the metallic sheath 22 of the shield 20. The rocking of the teeth 58 causes the sharp edges 59 of the teeth 58 to be displaced circumferentially along the shield 20 and scrape away those portions of the coating 24 engaged by the teeth 58, and exposes corresponding portions of the metallic sheath 22 of the shield 20 for direct electrical contact between the teeth 58 and the sheath 22, as shown at 80. It is noted that since the coating 24 is scraped away by the rocking action and circumferential displacement of the teeth 58, combined with some scraping away of the coating 24 which occurred when the inner plate 36 was advanced longitudinally along the cable 10 to interpose the inner plate 36 between the shield 20 and the core 12, a good electrical contact is attained without the necessity for actually piercing the metallic sheath 22 so that excessive clamping forces are not required to effect a suitable ground connection, and the construction of the inner plate 36, with the unitary toothed ribs 56 and the integral threaded post 64, is simplified and rendered more economical. The scraping action removes not only portions of the coating 24, but also any oxide deposits or other matter which could inhibit a good electrical connection between the shield 20 and the inner plate 36. At the same time, the jacket 16 and the shield 20 are clamped firmly between the outer and inner plates 34 and 36 to resist loosening of the grounding clamp connector 30 during service. The resiliently deflectable nature of the inner plate 36 compensates for any shifting of the jacket 16 or the shield 20 which may occur during service as a result of expansion and contraction of the cable 10 in response to changes in temperature, and as a result of the deformation and consequent shifting of the material of jacket 16 or shield 20 under the pressures exerted by the clamping forces established between the outer and inner plates 34 and 36, so that the teeth 58 always are biased into electrical contact with the metallic sheath 22 and a satisfactory ground connection is maintained continuously under the conditions encountered during service. Inner plate 36 and post 64 are electrically conductive so that once the grounding clamp connector 30 is fully installed, as seen in FIG. 2, a grounding strap (not shown) may be connected to post 64 to complete the desired ground connection to shield 20. Electrical performance is enhanced by the fact that the shield 20 need not be pierced entirely through the metallic sheath 22 thereof in order to effect the grounding connection to the shield 20, thereby maintaining electrical continuity as well as mechanical integrity along the shield 20.

It will be seen that the grounding clamp connector 30 accomplishes several objectives and attains a number of advantages, some of which are summarized as establishing a good electrical connection with the shield of the electrical cable by scraping away portions of the coating on the shield to expose corresponding portions of the metallic sheath of the shield for direct electrical contact between the grounding clamp connector and the shield; accomplishing the desired electrical contact automatically, in response to a simple installation procedure, without a significant departure from current conventional installation procedures; facilitating installation in the field; compensating for displacement of the materials of the cable resulting from deformation and from temperature differences so as to maintain an effective ground connection during service; enabling economy through simplicity of construction and ease of use; employing a minimal number of component parts of reduced complexity; and providing exceptional reliability over an extended service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In a cable shield grounding clamp connector for establishing an electrical connection with the shield of an electrical cable having an inner core of insulated conductors, an outer insulating jacket with an outer diameter, and a shield between the inner core and the outer jacket, the shield having an inner surface and including a metallic sheath and a corrosion inhibiting coating on the metallic sheath at least along the inner surface of the shield, an improvement for effecting the electrical connection and maintaining the electrical connection continuously during service in the field, the improvement comprising:

an outer plate extending longitudinally between opposite ends thereof and having a transverse cross-sectional configuration curved circumferentially along an arc of a first radius to conform essentially to the outer diameter of the jacket;

an inner plate extending longitudinally between opposite ends thereof and laterally between opposite edges thereof, the inner plate including a web portion curved circumferentially between the laterally opposite edges along an arc of a second radius;

clamping means for urging the outer plate and the inner plate toward one another; and scraping means located along the laterally opposite edges of the inner plate for projecting toward the outer plate when the inner plate and the outer plate are juxtaposed with one another, with the jacket and the shield interposed between the juxtaposed outer plate and inner plate;

the second radius being related to the first radius such that upon urging the outer plate and the inner plate toward one another, the inner plate will be resiliently deflected toward conformance with the curved configuration of the outer plate and the scraping means will be displaced concomitantly circumferentially along the shield to scrape away portions of the coating and make electrical contact with corresponding portions of the metallic sheath without piercing the metallic sheath, and will be biased continuously toward the metallic sheath to maintain the electrical contact continuously during service in the field.

2. The improvement of claim 1 wherein the second radius is greater than the first radius.

3. The improvement of claim 2 wherein the scraping means comprises sharp-edged teeth arranged in longitudinal rows along the laterally opposite edges of the inner plate and projecting essentially radially outwardly.

4. The improvement of claim 2 including longitudinal ribs extending along the laterally opposite edges of the inner plate, with the web portion extending circumferentially between the longitudinal ribs such that the inner plate is provided with a channel-like cross-sectional configuration, the scraping means being located along the longitudinal ribs.

5. The improvement of claim 4 wherein the web portion is resiliently deflectable relative to the outer plate.

6. The improvement of claim 4 wherein the scraping means comprises sharp-edged teeth arranged in longitudinal rows along the longitudinal ribs and projecting essentially radially outwardly.

7. The improvement of claim 6 wherein the web portion is resiliently deflectable relative to the outer plate.

8. The improvement of claim 7 wherein the outer plate has a first cross-sectional thickness, and the inner plate has a second cross-sectional thickness less than the first cross-sectional thickness.

9. The improvement of claim 1 wherein the clamping means includes an aperture in the outer plate, and a post affixed to the inner plate and projecting radially outwardly for extending through the aperture in the outer plate.

* * * * *